US008747087B2

(12) United States Patent
Collie et al.

(10) Patent No.: US 8,747,087 B2
(45) Date of Patent: Jun. 10, 2014

(54) SCROLL PUMP HAVING POCKETS FORMED IN AN AXIAL END FACE OF A SCROLL WALL

(75) Inventors: Clive Frederick Collie, Elstree (GB); Alan Ernest Kinnaird Holbrook, Pulborough (GB)

(73) Assignee: Edwards Limited (GB)

( * ) Notice: Subject to any disclaimer, the term of this patent is extended or adjusted under 35 U.S.C. 154(b) by 76 days.

(21) Appl. No.: 13/389,328

(22) PCT Filed: Aug. 3, 2010

(86) PCT No.: PCT/GB2010/051276

§ 371 (c)(1), (2), (4) Date: Feb. 7, 2012

(87) PCT Pub. No.: WO2011/018648

PCT Pub. Date: Feb. 17, 2011

(65) Prior Publication Data

US 2012/0134863 A1 May 31, 2012

(30) Foreign Application Priority Data

Aug. 14, 2009 (GB) ..... 0914228.2

(51) Int. Cl.

| | |
|---|---|
| ***F03C 2/00*** | (2006.01) |
| ***F03C 4/00*** | (2006.01) |
| ***F04C 2/00*** | (2006.01) |

(52) U.S. Cl.

USPC ..... 418/55.4; 418/55.1; 418/142

(58) Field of Classification Search

USPC ..... 418/55.1–55.6, 57, 104, 140, 142

See application file for complete search history.

(56) References Cited

U.S. PATENT DOCUMENTS

| | | | | |
|---|---|---|---|---|
| 4,437,820 | A | 3/1984 | Terauchi et al. | |
| 4,561,832 | A | 12/1985 | Shimizu | |
| 4,740,143 | A | 4/1988 | Nakamura et al. | |
| 5,035,589 | A * | 7/1991 | Fraser et al. | 418/55.4 |
| 5,833,443 | A | 11/1998 | Lifson | |
| 6,193,487 | B1 * | 2/2001 | Ni | 418/55.4 |
| 6,354,825 | B1 | 3/2002 | Fujiwara et al. | |
| 6,720,071 | B2 | 4/2004 | Ishii | |
| 6,783,338 | B2 | 8/2004 | Moroi et al. | |
| 7,364,418 | B2 | 4/2008 | Masuda et al. | |
| 2002/0057976 | A1 | 5/2002 | Kimura et al. | |
| 2003/0063989 | A1 | 4/2003 | Rinella | |

FOREIGN PATENT DOCUMENTS

| | | | |
|---|---|---|---|
| EP | 0438025 | A3 | 7/1991 |
| JP | 55037515 | A | 3/1980 |
| JP | 2001003882 | A | 1/2001 |
| WO | 9817895 | A1 | 4/1998 |
| WO | 0022302 | A1 | 4/2000 |

* cited by examiner

*Primary Examiner* — Theresa Trieu

(74) *Attorney, Agent, or Firm* — Shumaker & Sieffert, P.A.

(57) ABSTRACT

In some examples, a scroll pump 10 may include two scrolls, which are co-operable for pumping fluid from an inlet to an outlet on relative orbiting motion of the scrolls. Each scroll may include a respective scroll base from which a respective scroll wall extends generally axially towards the base of the opposing scroll. At least a first portion of one or each of the respective scroll walls has formed in an axial end face thereof a plurality of pockets distributed along the first portion for disrupting leakage of fluid from a high pressure side of the scroll wall to a low pressure side of the scroll wall.

13 Claims, 7 Drawing Sheets

SCROLL PUMP HAVING POCKETS FORMED IN AN AXIAL END FACE OF A SCROLL WALL

The present invention relates to a scroll pump, which is often referred to as a scroll compressor.

A prior art scroll compressor, or pump, 100 is shown in FIG. 13. The pump 100 comprises a pump housing 102 and a drive shaft 104 having an eccentric shaft portion 106. The shaft 104 is driven by a motor 108 and the eccentric shaft portion is connected to an orbiting scroll 110 so that during use rotation of the shaft imparts an orbiting motion to the orbiting scroll relative to a fixed scroll 112 for pumping fluid along a fluid flow path between a pump inlet 114 and pump outlet 116 of the compressor.

The fixed scroll 112 comprises a scroll wall 118 which extends perpendicularly to a generally circular base plate 120. The orbiting scroll 110 comprises a scroll wall 124 which extends perpendicularly to a generally circular base plate 126. The orbiting scroll wall 124 co-operates, or meshes, with the fixed scroll wall 118 during orbiting movement of the orbiting scroll. Relative orbital movement of the scrolls causes a volume of gas to be trapped between the scrolls and pumped from the inlet to the outlet.

A scroll pump may be a dry pump and not liquid lubricated. In order to prevent back leakage in this instance, the space between the axial ends of a scroll wall of one scroll and the base plate of the other scroll is sealed by a tip seal 128. An enlarged cross-section through a portion of the fixed scroll 112 showing the tip seal 128 in more detail is shown in FIG. 14.

As shown in FIG. 14, the tip seal 128, typically made from a plastics material (such as PTFE) or other polymer blend, is located in a channel 132 at the axial end 134 of the fixed scroll wall 118. There is a small axial gap between an axial end of the tip seal 128 and the base of the channel 132 so that in use fluid occupying the gap forces the tip seal axially towards the base plate 126 of the orbiting scroll. Accordingly, the tip seal is supported on a cushion of fluid which serves to urge the seal against an opposing scroll.

When bedding in or during use, the tip seals 128 are worn by contact with the opposing scroll base plate 120, 126 generating tip seal dust. When the pump is used for pumping a clean environment such as a vacuum chamber of a silicon wafer processing apparatus, it is desirable that the tip seal dust does not migrate upstream into the vacuum chamber, particularly during pump down times. Further, the periodic maintenance or replacement of tip seals adds to the cost of ownership of a pump.

The present invention provides a scroll pump comprising two scrolls which are co-operable for pumping fluid from an inlet to an outlet on relative orbiting motion of the scrolls, each scroll comprising a scroll base from which a scroll wall extends generally axially towards the base of the opposing scroll, wherein at least a first portion of one or each of the scroll walls has formed in an axial end face thereof a plurality of pockets distributed along said first portion for disrupting leakage of fluid from a high pressure side of said scroll wall to a low pressure side of said scroll wall.

Other preferred and/or optional aspects of the invention are defined in the accompanying claims.

In order that the present invention may be well understood, several embodiments thereof, which are given by way of example only, will now be described with reference to the accompanying drawings, in which.

Figure 1:
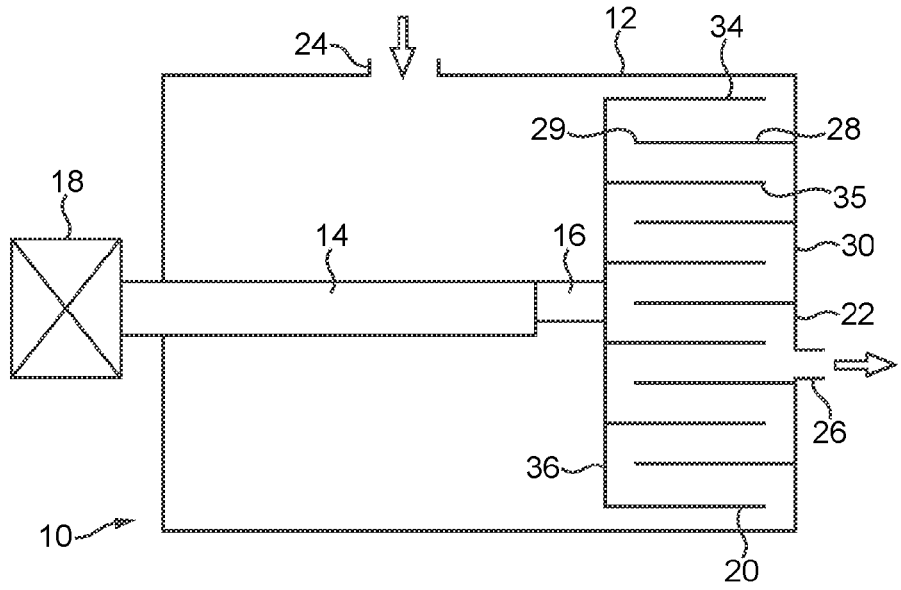
FIG. 1 shows schematically a scroll pump.

A scroll compressor, or pump, 10 is shown in FIG. 1. The pump 10 comprises a pump housing 12 and a drive shaft 14 having an eccentric shaft portion 16. The shaft 14 is driven by a motor 18 and the eccentric shaft portion is connected to an orbiting scroll 20 so that during use rotation of the shaft imparts an orbiting motion to the orbiting scroll relative to a fixed scroll 22 for pumping fluid along a fluid flow path between a pump inlet 24 and pump outlet 26 of the compressor.

The fixed scroll 22 comprises a scroll wall 28 which extends perpendicularly to a generally circular base plate 30 and has an axial end face, or surface, 29. The orbiting scroll 20 comprises a scroll wall 34 which extends perpendicularly to a generally circular base plate 36 and has an axial end face, or surface, 35. The orbiting scroll wall 34 co-operates, or meshes, with the fixed scroll wall 28 during orbiting movement of the orbiting scroll. Relative orbital movement of the scrolls causes a volume of gas to be trapped between the scrolls and pumped from the inlet to the outlet.

As indicated above with reference to the prior art, a scroll pump may be a dry pump and not lubricated. Therefore, in order to prevent back leakage, the space between the axial ends 29, 35 of a scroll wall of one scroll and the base plate 30, 36 of the other scroll is sealed by a sealing arrangement, which generally comprises tip seals. The tip seals close the gap between scrolls caused by manufacturing and operating tolerances, and reduce the leakage to an acceptable level. However, tip seals suffer from the generation of tip seal dust and require a period of bedding in before achieving operational requirements. Further, in a normal scroll pump, tip seals require replacement at regular intervals after they become worn.

Figure 2:
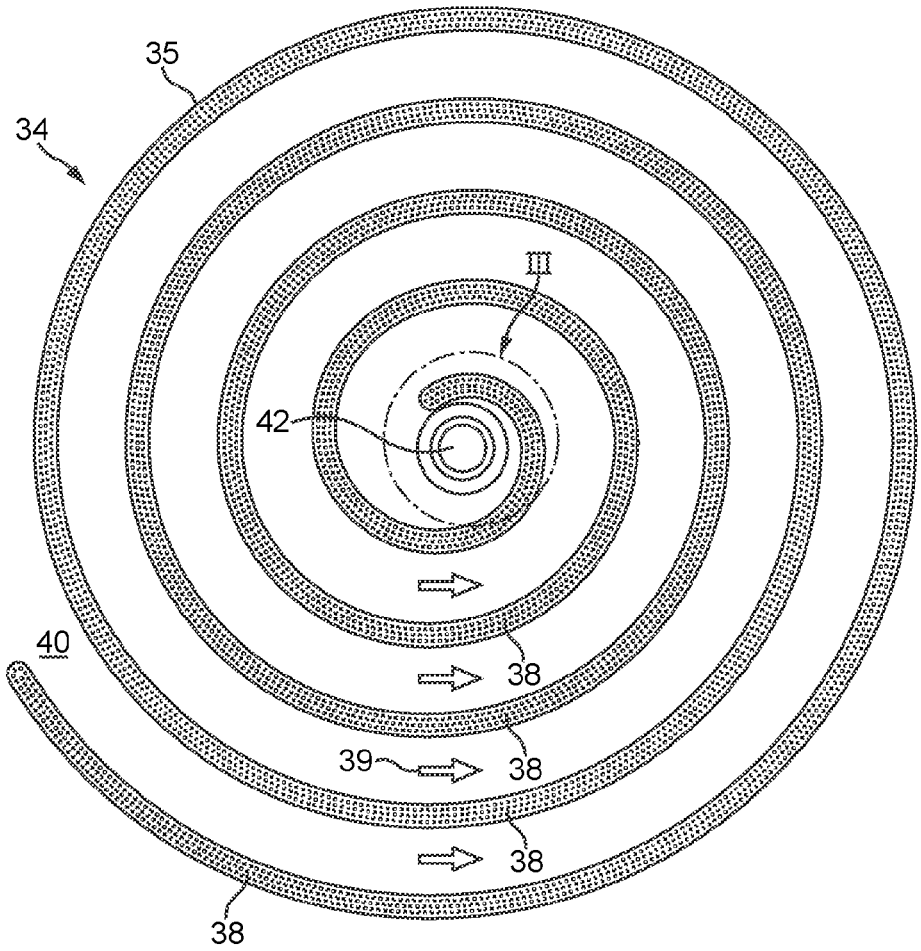
FIG. 2 shows a plan view of an orbiting scroll wall of the scroll pump shown in FIG. 1.

FIG. 2 shows a plan view of the orbiting scroll wall 34 having a sealing arrangement at the axial end face 35 thereof The remaining description makes specific reference to the orbiting scroll but it will be appreciated that the fixed scroll wall 28 may typically have a similar sealing arrangement at an axial end face 29 thereof The axial end face 35 of the orbiting scroll wall 34 has a plurality of pockets 38 distributed along said face for disrupting leakage of fluid from a high pressure side of said scroll wall to a low pressure side of said scroll wall.

When fluid is pumped by a scroll pumping mechanism between an inlet 40 and an outlet 42 of the arrangement along a flow path 39, a pressure differential is generated across the scroll walls 28, 34. The pressure is lower towards the inlet 40 at a radially outer portion, or side, of the arrangement and higher towards the outlet 42 at a radially inner portion, or side, of the arrangement. Therefore, the scroll wall sealing arrangement is adapted to resist the tendency of fluid to flow in a radially outer direction. The pockets 38 interact with the fluid being pumped and disrupt fluid flow in a radial outer direction across the axial end face of the scroll wall.

Figure 3:
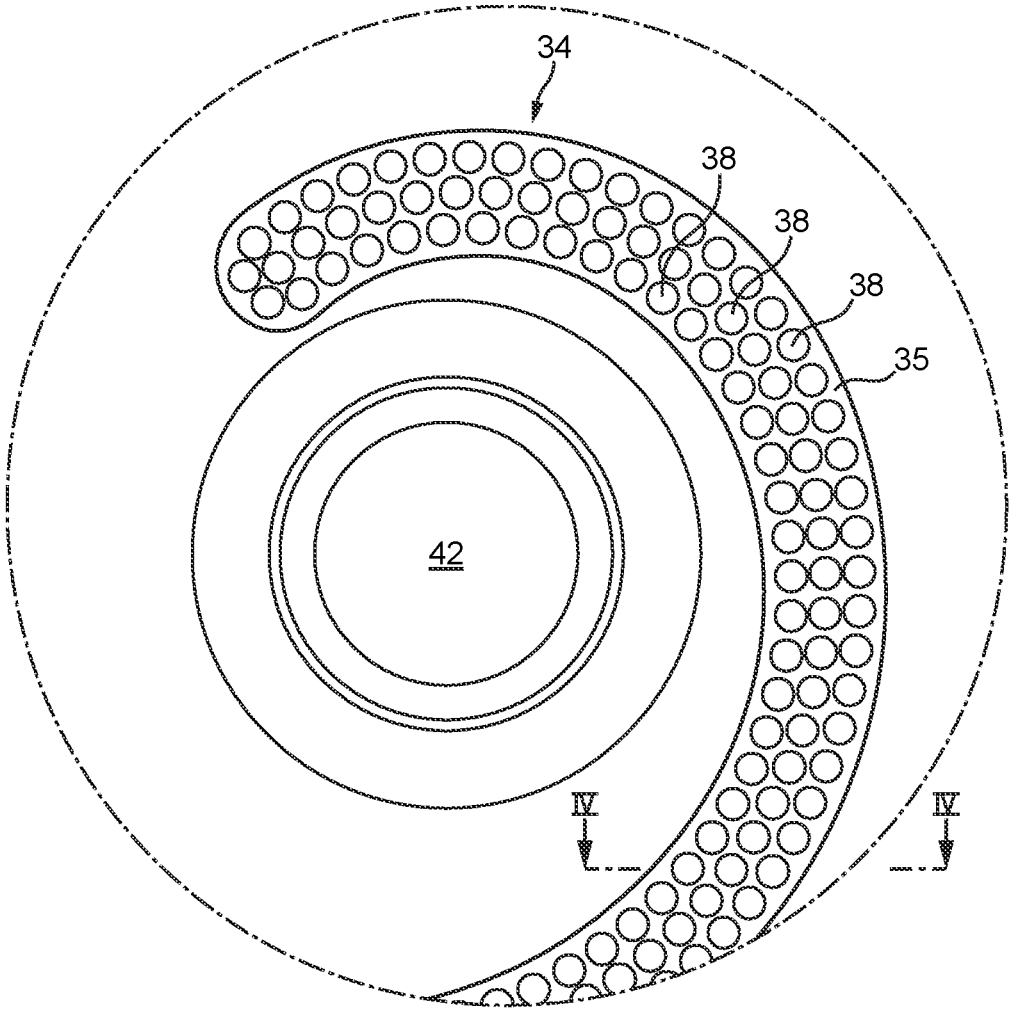
FIG. 3 shows an enlarged view of the orbiting scroll wall shown in FIG. 2.

FIG. 3 is an enlarged view of section III shown in FIG. 2. As shown in FIG. 3, the orbiting scroll wall 34 has axial end face 35 in which are formed a plurality of pockets 38. In this example, the pockets 38 are generally circular in plan view and extend in three rows along the spiral length of the scroll wall. The invention encompasses other pocket shapes and arrangements as described in more detail below. The arrangement shown provides a relatively uniform distribution of pockets over the axial end face 35 and increases the possibility of fluid interacting with one or more pockets 38 when leaking across the end face. When fluid travelling in a radially outer direction interacts with a pocket, its flow is interrupted, reducing the rate of flow. A uniform distribution of pockets reduces the possibility of fluid travelling in a radially outer direction through one or more areas of the axial end face 35 where pockets are less concentrated.

Figure 4:
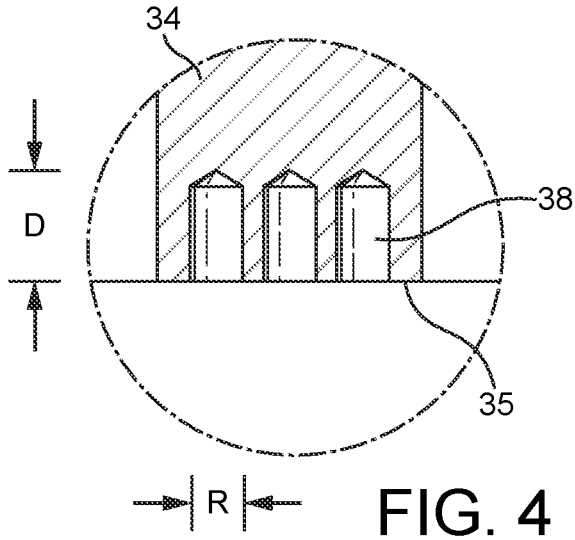
FIG. 4 shows a cross-section of the scroll wall taken along the line IV-IV in FIG. 3.

FIG. 4 shows a section view taken along the line IV-IV in FIG. 3. As shown, there are three pockets 38 formed in axial end face 35 across the radial width of the orbiting scroll 34. Each pocket has a depth D which may be about 0.5 to 2 mm and a radial width R which may be about 0.5 to 3 mm. The pocket dimensions will be determined by the pressure conditions, gas type (molecular mass and viscosity) end clearance and scroll orbiting speed. The pockets may be made by machining the axial end face of the scroll walls.

As shown in FIGS. 2 to 4, the pockets are distributed generally uniformly over the axial end face 35. In an alternative arrangement, the or each axial end face 29, 35 is divided into a plurality of regions and the size, shape and arrangement of the pockets in one region are selected to be different to the size, shape and arrangement of the pockets in one or others of said regions. This arrangement allows the pockets in each region to be selected to disrupt leakage generated by conditions local to the respective region. For example, a first region which is at the inlet is required to disrupt molecular flow of fluid across the axial end face at relatively low pressures (e.g. 0.1 mbar). A second region which is further towards the outlet is required to disrupt continuum flow of fluid across the axial end face at a higher pressure (e.g. 10 mbar). The size, shape and arrangement of the pockets in the first and second region are different and selected according to disrupt fluid flow at 0.1 mbar and 10 mbar respectively. The size, shape and arrangement of the pockets are configured to cause a net flow of fluid from an inlet side to an outlet side of the scroll wall or walls for molecular flow and minimize the leakage across the scroll wall or walls for continuum flow. For example, the arrangement shown in FIGS. 2 to 4 could be adopted at a region towards the outlet whereas an arrangement described later with reference to FIGS. 10 to 12 could be adopted towards the inlet, the latter arrangement being particularly configured for molecular flow conditions.

Figure 5:
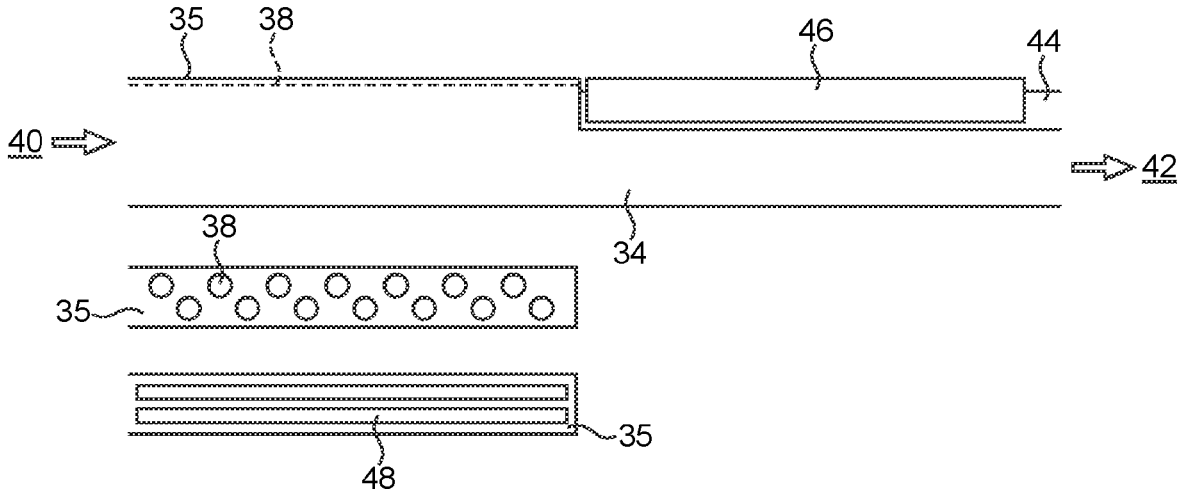
FIG. 5 shows a cross-section along a centre line of the scroll wall showing a further example of a scroll wall for the pump shown in FIG. 1.
Figure 14:
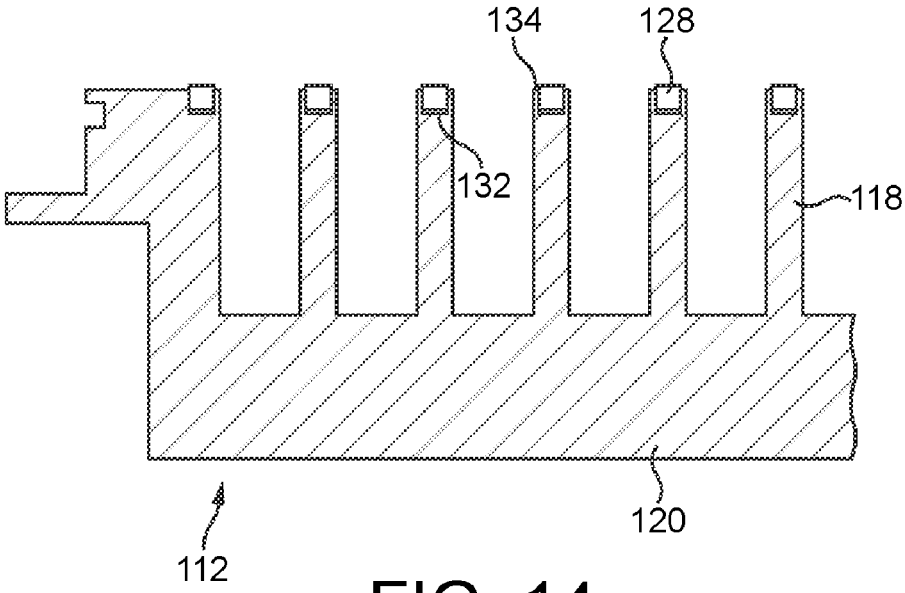
FIG. 14 (Prior Art)
FIG. 14 shows a portion of a scroll of the prior art pump.

FIG. 5 is a cross-section taken through a centre line of an alternative orbiting scroll wall 34 and extending along the spiral length of the wall from the inlet 40 to the outlet 42. In FIG. 5, the sealing arrangement described generally with reference to FIGS. 2 to 4 extends along the axial end face 35 of a first portion of the scroll wall 34 from the inlet 40. A second portion of the scroll wall towards the outlet 42 comprises a channel 44 in which is received a tip seal 46 (as shown in more detail in FIG. 14) for resisting fluid flow across the scroll wall in a radially outer direction where non-molecular, or continuum, flow occurs. FIG. 5 shows in plan view pockets 38 in an axial end face 35 of the scroll wall 34 and an alternative sealing arrangement comprising pockets 48 extending along a spiral length of the axial end face 35. As shown in FIG. 5, the first portion and the second portion are approximately equal in extent. However, the first portion and the second portion may be different in extent and selected according to the sealing requirements of the pump along the spiral extent of the scrolls.

FIGS. 6 to 9 shows further sealing arrangements comprising an arrangement of pockets in the axial end face 35. The shape, size and arrangement of the pockets are selected according to requirements, such as the pressure regime, and the molecular weight and viscosity of the fluid being pumped.

Figure 6:
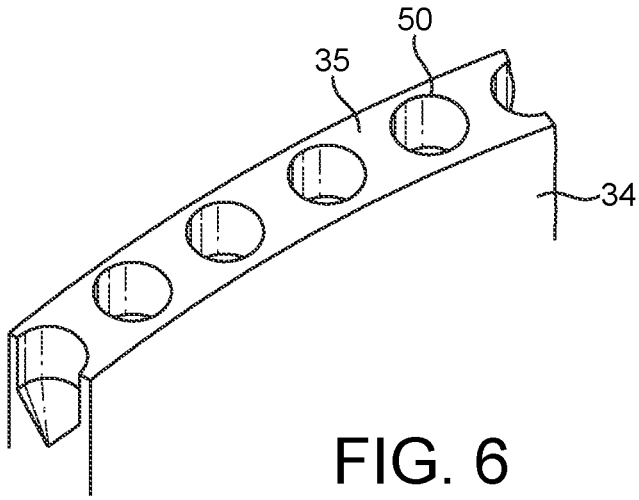
FIGS. 6 to 9 show still further examples of scroll walls for the pump shown in FIG. 1.

FIG. 6 shows a single row of generally circular pockets 50 extending along a spiral length of the axial end face 35. The pockets are relatively larger compared to pockets 38 shown in FIGS. 2 to 4. Relatively larger pockets may reduce the possibility of the pockets disrupting flow across the entire extent of the axial end face 35, but conversely are relatively easier to machine in the axial end face.

Figure 7:
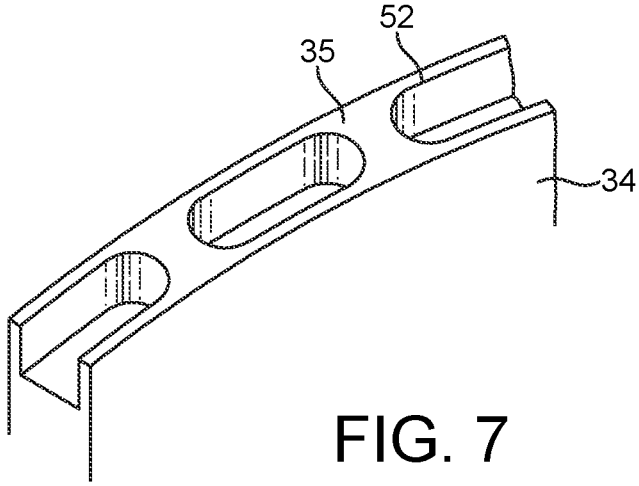

FIG. 7 shows a single row of elongate pockets 52 extending along a spiral length of the axial end face 35. The pockets are relatively larger compared to pockets 38 and 50 shown in FIGS. 2 to 4.

Figure 8:
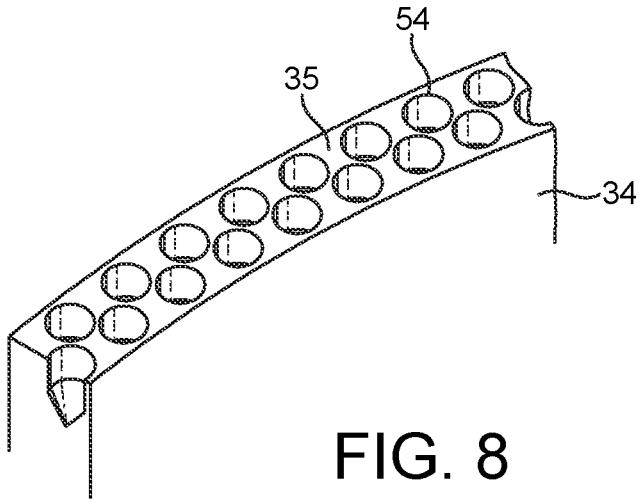

FIG. 8 shows two rows of generally circular pockets 54 extending along a spiral length of the axial end face 35. Unlike pockets 50 shown in FIG. 6 where there are radial paths which extend in a radial direction between the pockets along which fluid may flow without encountering a pocket, the pockets 54 are staggered or misaligned. In this way, fluid leaking across the scroll wall in a radial direction would generally interact with a pocket and therefore disruption of leakage would be increased.

Figure 9:
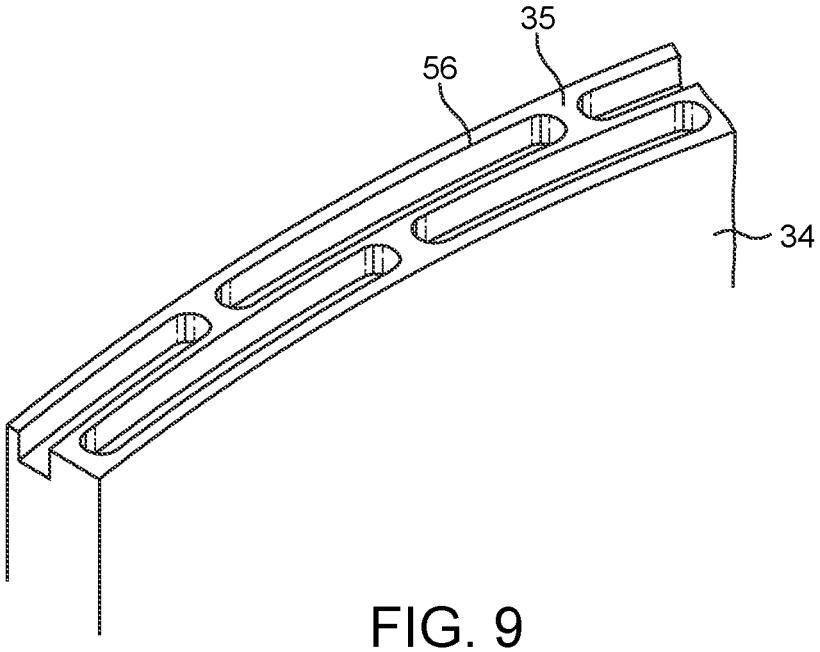

FIG. 9 shows two rows of elongate pockets 56 extending along a spiral length of the axial end face 35. Unlike pockets 52 shown in FIG. 7 where there are radial paths extending between the pockets along which fluid may flow without encountering a pocket, the pockets 56 are staggered thereby increasing disruption to leakage.

The pockets 54, 56 are not aligned in the radial direction across the radial width of a scroll wall so that a clear path is not provided for the flow of fluid molecules between pockets from the outlet side to the inlet side. If the pockets are not aligned there is a much higher possibility of the molecules interacting with a pocketing and it disrupting flow. In this way, the pockets form a labyrinth allowing back-leakage generally only if the molecules flow along a tortuous path through the labyrinth.

Figure 10:
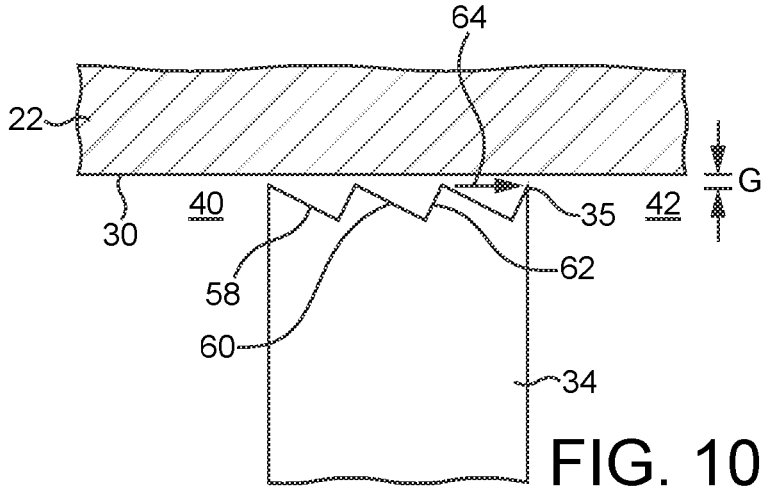
FIGS. 10 to 12 shows three more examples of scroll walls for the pump shown in FIG. 1.
Figure 11:
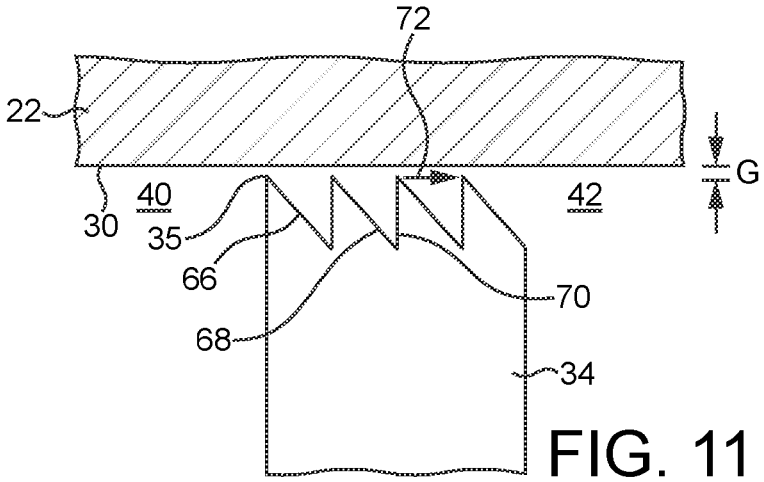
Figure 12:
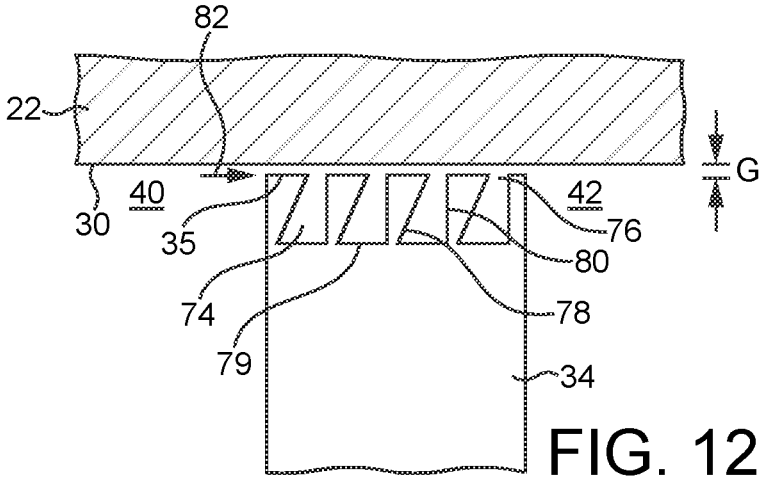
Figure 13:
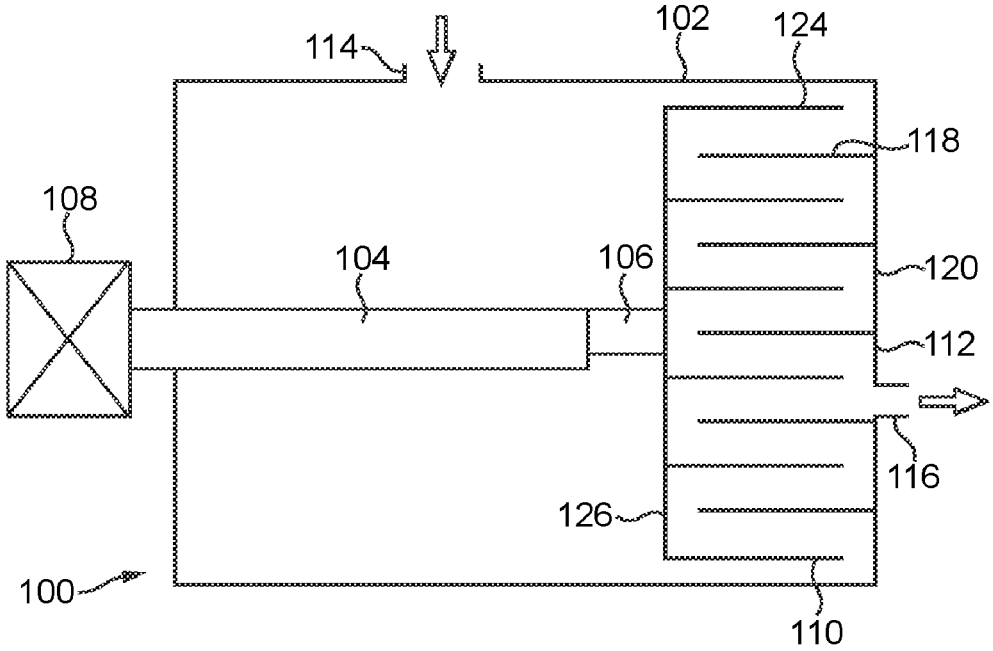
FIG. 13 (Prior Art)
FIG. 13 shows schematically a prior art scroll pump.

FIGS. 10 to 12 show three further examples of sealing arrangements comprising pockets formed in the axial end face 35 of the orbiting scroll 34. The fixed scroll 22 is also shown comprising base plate 30. The sealing arrangements seal gap G which is the axial distance between the axial end face 35 and the base plate 30. The arrangements shown in FIGS. 10 to 12 are particularly suited for disrupting molecular flow at low pressures when a gas predominantly behaves as individual molecules and not as a fluid. As shown, the arrangements are configured for directing movement of molecules in a radially outer direction.

Referring specifically to FIG. 10, a pressure differential is generated across scroll wall 34 during pumping. The pressure is less on an inlet side 40 of the wall and greater on an outlet side 42 of the wall. Accordingly, there is a potential for molecules to flow from the outlet side to the inlet side along the pressure gradient. When such flow occurs, the molecules interact with pockets 58. The pockets are formed by serrations in the axial end face 35. The pockets may be formed by grooves which are closed at each end or channels which are open at each end. The pockets 58 comprise a shallow relatively long face 60 and a steep relatively short face 62. The terms 'long' and 'short' in this context refer to their extent in the radial width direction. The face 60 is longer than face 62 and therefore interacts with more molecules. As face 60 is angled to direct molecules to flow towards the outlet, the overall effect is net flow of molecules in the direction of the outlet 42 as indicated by arrow 64.

FIG. 11 shows an arrangement similar to FIG. 10 in which pockets 66 are formed by serrations in the axial end face 35. Pockets 66 have a long shallow face 68 and a short generally vertical face 70. As explained above, the purpose of the recesses in the axial end face 35 are to produce a net flow of molecules in the direction of arrow 72 towards the outlet 42.

FIG. 12 shows a further sealing arrangement in which the pockets 74 are formed by cavities in the axial end face 35. The cavities may be open or closed at spiral ends thereof. The cavities 74 comprise a relatively narrow opening 76, a sloping internal wall 78, a bottom face 79 and a vertical internal wall 80. The cavities trap molecules and the bottom face 79 biases the exit direction of molecules from the cavity in the direction of arrow 82 towards the outlet 42.

As shown in FIGS. 10 to 12, the sealing arrangement seals, or disrupts the flow, in the gap G between the axial end face 35 (or the axial end face 29 of the fixed scroll wall) and the base plate 30 (or the base plate 36 of the orbiting scroll wall). In the embodiments, the scroll pump should be adapted so that the gap G is relatively small. It is preferred that the gap G is less than about 50 μm and more preferably less than 20 μm. If the size of gap G becomes relatively large significant amounts of molecules may flow through the gap without interacting with a pocket. In this case, back-leakage may be problematic. The gap G should therefore be sufficiently small so that a relatively large amount of the molecules passing through the gap interacts with the pockets and is caused to flow back towards the outlet side 42 of a scroll wall.

The sealing arrangement described herein functions most efficiently in molecular flow conditions. Generally such conditions are to be found in the scroll pumping arrangement towards the inlet 40. If though the scroll pump does not exhaust to atmosphere, the pressure regime towards the outlet may be sufficiently low to achieve efficiency in the sealing arrangements described herein.

Whilst many different examples of pockets have been described herein, the invention is not limited to such structures or arrangements. The purpose of the pockets is to disrupt flow across a scroll wall from a high pressure side to a low pressure side. For example, a honeycomb structure providing a multiplicity of pockets could be formed in the axial end face of the scroll wall or walls.

There are a number of advantages associated with the present sealing arrangement, some of which have already been discussed above. If the sealing arrangement extends over the entire spiral extent of both scrolls it does not generate tip seal dust which can contaminate systems upstream or downstream of the pump. If the sealing arrangement extends only over a first portion of the scroll walls and a second portion comprises tip seals, then the amount of tip seal dust generated will be less than in the prior art as there is less tip seal to generate dust. The present sealing arrangement does not require bedding in and therefore it is ready for use without the cost and time of bedding in. Additionally, the present sealing arrangement is a non-contact sealing arrangement and therefore provides less resistance to relative movement of the scrolls thereby reducing power requirement.

As indicated above pockets may be formed in the axial end face of either the fixed scroll wall or the orbiting scroll wall or in both scroll walls. However, fewer holes or serrations are required in the orbiting scroll wall to achieve disruption, making this approach more efficient to manufacture.

The invention claimed is:

1. A vacuum scroll pump comprising:

a first scroll and a second scroll which are co-operable for pumping fluid from an inlet to an outlet on relative orbiting motion of the first and second scrolls, wherein the first scroll comprises:

a first scroll base from which a first scroll wall extends generally axially towards a second scroll base of the second scroll, wherein a first portion of the first scroll wall has formed in an axial end face thereof a first plurality of pockets distributed along the first portion for disrupting leakage of fluid from a high pressure side of the first scroll wall to a low pressure side of the first scroll wall, wherein a second portion of the first scroll wall has formed in the axial end face thereof a second plurality of pockets distributed along the second portion for disrupting leakage of fluid from the high pressure side of the first scroll wall to the low pressure side of the first scroll wall, and wherein a configuration of the first plurality of pockets is different than a configuration of the second plurality of pockets so that the first plurality of pockets and the second plurality of pockets disrupt leakage generated by conditions local to the first region and the second region, respectively.

2. The vacuum scroll pump of claim 1 , wherein the first plurality of pockets are configured to disrupt molecular flow conditions.

3. The vacuum scroll pump of claim 2, wherein the first plurality of pockets and the second plurality of pockets together are distributed from the inlet to the outlet.

4. The vacuum scroll pump of claim 1, wherein the second plurality of pockets are configured to disrupt continuum flow conditions.

5. The vacuum scroll pump of claim 1, wherein the second scroll comprises a second scroll wall having a third plurality of pockets formed in an axial face of the second scroll wall.

6. The vacuum scroll pump of claim 1, wherein the configuration comprises at least one of the size, shape, or arrangement of the pockets.

7. The vacuum scroll pump of claim 1, wherein the pockets of the first and second plurality of pockets are configured to cause a net flow of fluid from an inlet side to an outlet side of the first scroll wall.

8. The scroll pump of claim 1, wherein the first plurality of pockets are distributed uniformly over the axial end face of the first portion of the first scroll wall so that leakage can be disrupted along the entire extent of the first portion.

9. The vacuum scroll pump of claim 1, wherein the pockets of the first plurality of pockets are formed in one or more rows.

10. The vacuum scroll pump of claim 9, wherein more than one row of pockets are formed in the axial end face of the first scroll wall and the pockets in each row are misaligned thereby increasing the possibility of fluid flowing in a radial direction across the axial end face interacting with a pocket.

11. The vacuum scroll pump of claim 1, wherein the axial end face of the first scroll wall is spaced by an axial distance from the second scroll base forming a non-contact sealing arrangement.

12. The vacuum scroll pump of claim 11, wherein the axial distance is such that fluid flowing between the sealing surfaces is caused to interact with at least one pocket of the first plurality of pockets or the second plurality of pockets.

13. The vacuum scroll pump of claim 12, wherein the axial distance is less than 50 μm.

* * * * *